United States Patent [19]

Gerhard

[11] 4,307,812

[45] Dec. 29, 1981

[54] FREIGHT CONTAINER FOR FLOWABLE SUBSTANCES

[75] Inventor: Helmut Gerhard, Weitefeld, Fed. Rep. of Germany

[73] Assignee: Westerwalder Eisenwerk Gerhard GmbH, Weitefeld, Fed. Rep. of Germany

[21] Appl. No.: 52,889

[22] Filed: Jun. 28, 1979

[30] Foreign Application Priority Data

Jun. 28, 1978 [DE] Fed. Rep. of Germany ..... 2828349

[51] Int. Cl.[3] ..... B65D 88/06; B65D 88/12; B65D 90/00

[52] U.S. Cl. ..... 220/1.5; 220/5 A; 220/71

[58] Field of Search ..... 220/1.5, 5 A, 71, 83, 220/70.1, 72.1, 401, 1 B, 5 R

[56] References Cited

U.S. PATENT DOCUMENTS

| | | | |
|---|---|---|---|
| 2,477,831 | 8/1949 | Schmitz, Jr. | 220/1 B |
| 3,661,293 | 5/1972 | Gerhard et al. | 220/5 A X |
| 3,726,431 | 4/1973 | Botkin | 220/72.1 |
| 3,730,384 | 5/1973 | Ramme | 220/71 |
| 3,912,103 | 10/1975 | Gerhard | 220/1.5 |
| 3,971,491 | 7/1976 | Mowatt-Larssen et al. | 220/71 |
| 4,065,022 | 12/1977 | Cainand | 220/71 |
| 4,098,426 | 7/1978 | Gerhard | 220/401 |

FOREIGN PATENT DOCUMENTS

| | | | |
|---|---|---|---|
| 2137075 | 12/1972 | France . | |
| 1210304 | 10/1970 | United Kingdom | 220/1.5 |

OTHER PUBLICATIONS

Brochure by Clones Company, Monaghan, Ireland, "Containers and Pressure Vessels Limited; 4/75.

Brochure by Design 2000 Ltd., Lancashire, UK., "Isospider"; 8/77.

*Primary Examiner*—Allan N. Shoap

*Attorney, Agent, or Firm*—Craig and Antonelli

[57] ABSTRACT

A freight container for flowable substances comprising a fully closed vessel formed at least partly of cylindrical sheet metal, two rectangular end frames interconnected by corner fittings for lifting and stacking the freight container and saddle members connected to the vessel and respective frame members. According to preferred embodiments, the saddle members are formed of sheet sections of an arched area and planar triangular surfaces adjacent opposite lateral edges of the arched area, each of the saddle members being interposed between an adjacent corner of the end frames and the vessel. The arched area has a conical surface having an apex located near an associated corner of the end frames and an arcuate base edge curved to conform with the wall of the vessel. Each of the triangular surfaces has an axial outer edge beginning near the apex of the conical surface and extending outwardly therefrom and being connected to an adjacent one of the members of the end frames. The saddle members support the tank in a manner so as to accept loads in horizontal, vertical, axial and radial directions.

26 Claims, 14 Drawing Figures

FREIGHT CONTAINER FOR FLOWABLE SUBSTANCES

The invention relates to a freight container for flowable substances according to the introductory part of the main claim.

If a self-supporting fully closed vessel is to be used as a freight container conforming to standards, it must be provided with rectangular or square-shaped end frames which serve to contain lift and stacking forces and, in order to contain axial shearing forces, are connected to each other by at least one floor group. The vessel must then be introduced. into the frame made in this way. Saddle members attached to the frames are needed for the connection of the frame with the vessel, the vessel being carried in the saddle members.

Many designs of such saddle members are known, all of which, however, leave much to be desired. This stems from the fact that the saddle members should meet a number of requirements which are partly contradictory or can all be met only with difficulties.

A systematic analysis of non-typical support structures shows that with desired characteristic features also undesired ones must be accepted. To the design targets belong the following:

Low weight, connection between the saddle member and the tank which is safe from fatigue even after a long period of use; high stability and at the same time elasticity; extensive avoidance of hollows, the inner surfaces of which could start corroding in an atmosphere which contains salt or is otherwise agressive; accessibility and working of all weld connections from two sides; observance of narrow iso end tolerances between corner fittings by a provision of a dimensional clearance for the assembly after tank shrinkage caused by welding has taken place; easy maintenance due to dismountability of the frame for repairs and straightening of the tank; inexpensive manufacture of the end saddle members while avoiding welds and shrinkage connected therewith and manufacture of the saddle members as far as possible from a metal sheet section; avoidance of tension peaks in all parts; avoidance of expensive shaping of the saddle members and provision of a connection of the saddle member and the reinforcing ring of the vessel which allows also the often needed selection of the vessel contents of up to the permissible maximum limit.

Particularly, it has been nearly impossible to reduce the tensions caused by the connection of the tank with the frame via the saddle members and the floor group to such an extent that cracks due to fatigue are avoided. Already the shrinking effect which takes place when the cylindrical tank is welded on to saddle members may be sufficient to exceed the narrow tolerances of the prescribed distances between corner fittings of the freight container.

The aim of the invention according to the characterizing part of claim 1 is to provide a freight container of the described kind, the saddle members of which may be connected to the vessel while keeping exact dimensions, without noticeable disadvantages in other respects.

According to the invention, each saddle member is formed from a sheet metal section into a shell element which is resistant to bending and whose inside edge is matched to, and connected to, a securing ring which surrounds the container, and whose outer edge is securely connected to, preferably welded to, the right angle of the associated corner of the frame and preferably to the adjacent corner props and transverse beams. Thus, welded joints between the frame and the shell-shaped saddle member, and between the saddle member and the rings which surround the container, may be produced on at least one side by means of lap welded joints, whereby it is possible to provide stress-free adaptation to the actual dimensions concerned whilst observing the prescribed tolerances.

The form of the saddle members mentioned, which provide the transition from the rectangular frame to the circular tank cross-section, corresponds to a conical region with flat triangular regions adjacent thereto on both sides. The apex of the conical shell always lies in the corner region of the container, the conical shell intersects a sectional plane perpendicular to the container axis in a circular line and is there welded or bolted to an annular flange which is formed on, or applied to, the container. The outer edges of the triangular regions which are adjacent to the conical shell on both sides provide the transition between the saddle member and the frame profiles. Preferably the triangular regions extend parallel to the inner and outer flanks of the corner props and transverse beams of the frontal frame which are to be connected thereto. In view of the fact that the planes of the triangular regions are parallel to the flanks of the corner props and transverse beams of the frontal frame which are to be connected thereto, not only are the otherwise required bevels of the triangular regions which are to be connected to the frame profiles superfluous, but it is possible to use mutually coincident saddle members also when the container is to be assembled between the corner fittings of the frontal frame in a position in which it is displaced within certain tolerance limits. Such as asymmetric assembly is, for example, required when, as is the case with containers for gaseous media, a manhole block flange with a heavy lid and appropriate sealing bolts are to be provided on a floor side of the container. Thus the individual manufacture of the saddle members for each frame corner can be dispensed with. Moreover, it is possible to compensate for differences in length between the length of the container and the length of the container frame, which is determined by the frontal frame in combination with the floor group, by simple displacement of the triangular regions along the outer or inner flank of the frontal frame profiles during assembly.

In view of the improved design of the saddle members described, there is the further achievement that all the reinforcement regions which are disposed on one side of the container and which are formed by the triangular regions, lie in one plane, which is of advantage for the reception and transmission of expansion or buckling forces.

The saddle members may be welded directly to the securing rings; however, they may alternatively be welded to a flange member, which is bolted to the securing ring which sits on the container.

If the securing ring comprises a cylindrical portion surrounding the container and a radially outwardly extending portion, the radially outwardly extending portion being bolted to the flange member which is secured to the conical region, and if a saddle ring having an angle section is chosen as the flange member, whose cylindrical portion lies above the cylindrical portion of the securing ring which lies against the container shell and is connected, preferably welded, by its end facing the frontal frame to the closure edge of the conical region, its radially outwardly extending portion extending parallel to the radially outwardly extending portion of the securing ring and connected, preferably bolted, thereto, then it is possible, for the purpose of optimising the container volume, to sever the annular flange sections, which possibly protrude radially outwardly beyond the permissible width of the container, by means of a vertical cut defining a secant, because it has been found that the remaining, predominantly cylindrical, residual cross-sections of both rings are of adequate rigidity to cope with all test stresses.

The new saddle design also entirely fulfills the other requirements mentioned above.

Some exemplary embodiments of the invention will now be described with reference to the drawings, in which.

Figure 1:
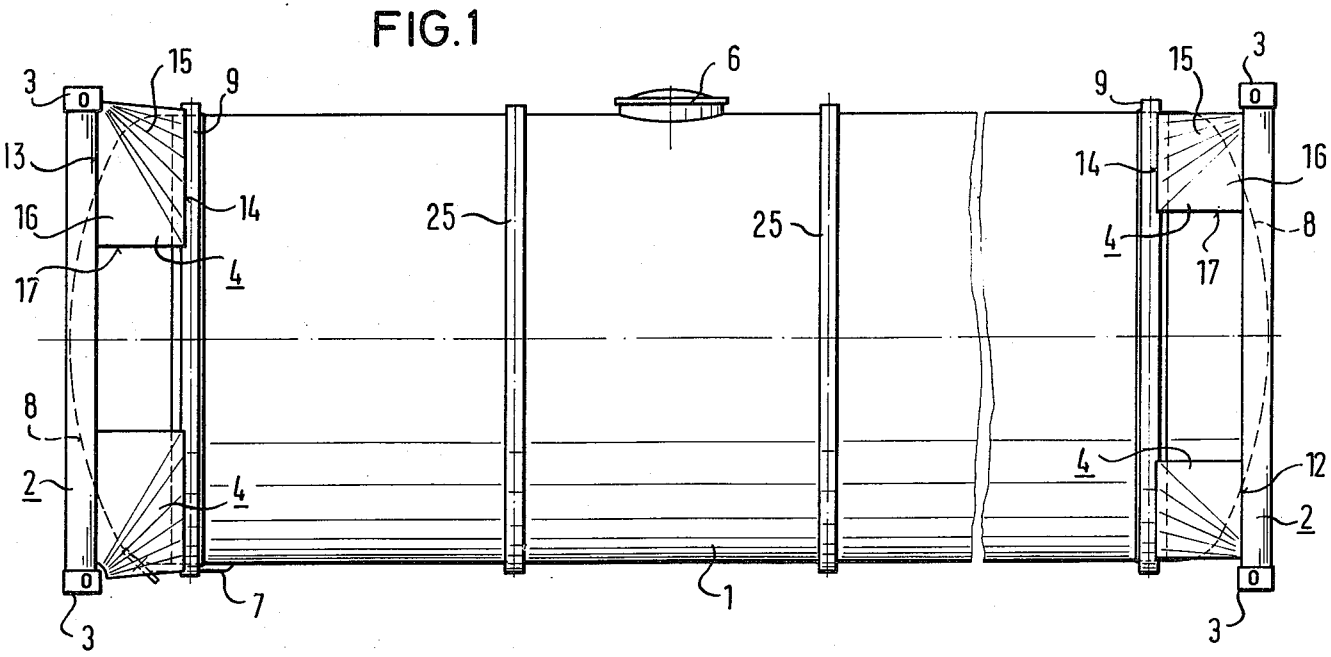
FIG. 1 is a side view of a freight container having the new saddle design in a variety of embodiments.

The freight container shown in the fragmentary view of FIG. 1 consists basically of a cylindrical pressure vessel 1 of circular cross-section, two rectangular end frames 2 of standard dimensions with corner fittings 3 for lifting and stacking, eight saddle members 4 connecting the vessel to the frame and a floor group 5 (FIGS. 12, 13), which interconnects the two frames.

The shell of the horizontal vessel 1 is made up of cylindrical sheet metal elements and preferably provided with reinforcing rings 25, a manhole 6 and a discharge trough 7. Dished ends 8 close the vessel 1 at its ends.

In the vicinity of the floor mountings, the cylindrical vessel 1 is provided with flange rings 9 welded thereto, which in the embodiment shown have bolt holes 10 distributed through the shell saddle region.

Each frame 2 is made up of corner props 11 and transverse beams 21, which are connected via the corner fittings 3.

Figure 2:
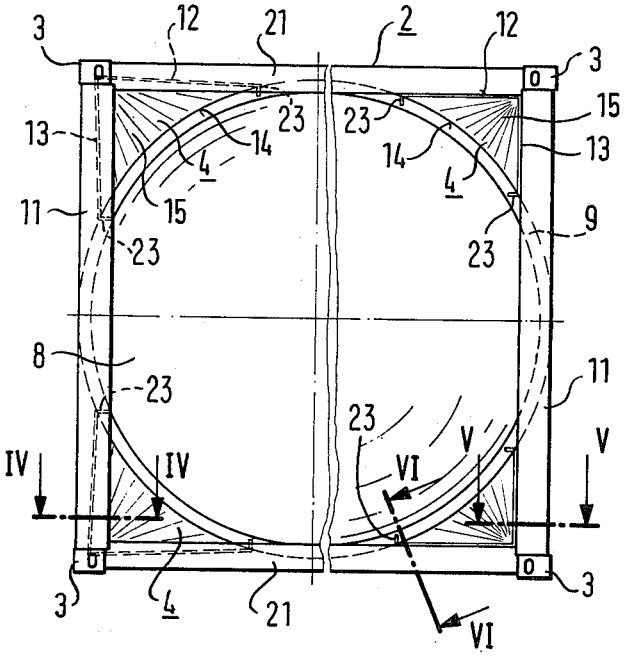
FIG. 2 is a front view of the latter.

Each of the saddle members 4 consists of a sheet metal section which has a right angled bend on one side and a circular bend on the other, and whose surface consists of two exterior, planar triangles 16 and a conical shell providing the transition therebetween. The section 15 thus defines a sharp right angle at its outer longitudinal edges 12 and 13, whereas the longitudinally inner edge 14 has a circular bend, such that it hugs the flange ring 9 or the outer flange 18 of an associated pair of rings. Each saddle member thus defines in its corner region a section of a conical surface 15, whose apex will be found in or on the corner fitting 3 concerned, and which intersects the plane of the flange ring 9, which is perpendicular to the vessel axis along a circular line. Adjacent on either side to this conical surface are planar triangular surfaces 16, whose outer edges 12 and 13 provide the transition to the corner props 11 and transverse beams 21. The closure edges 17 (FIG. 1) in the longitudinal direction of the vessel of these triangular surfaces may be provided with flanges 23 (FIGS. 2, 3 and 6).

Figure 4:
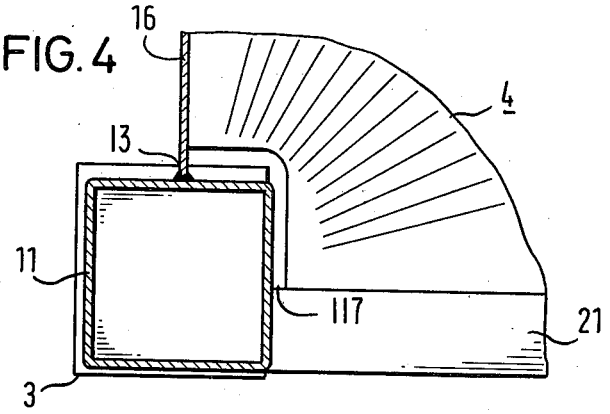
FIGS. 4 to 6 are different fragmentary views corresponding to the sections on IV—IV, V—V and VI—VI in FIG. 2.
Figure 5:
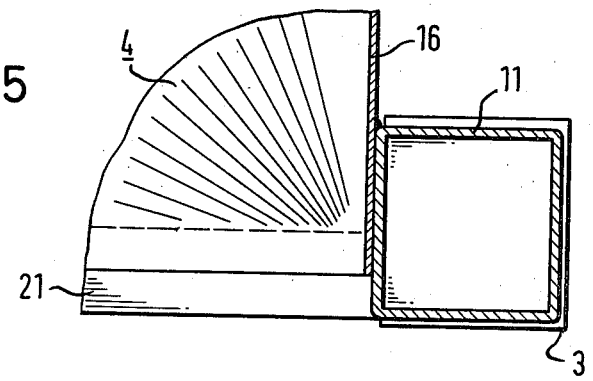

The outer edges 12 and 13 (FIG. 1, top left) of the triangular surfaces 16 are either butt welded to the corner props 11 and transverse beams 21 (left hand side of FIGS. 2 and 4) or secured in an overlapping manner to the inner surfaces (FIG. 2, top right and FIG. 5) or the outer surfaces (FIG. 2, bottom right) of the corner props 11 and the transverse beams 21. In the first case the saddle members may extend around the corner props 3 with or without a recess 117 in the apex of the cone (FIGS. 4 and 5).

Figure 3:
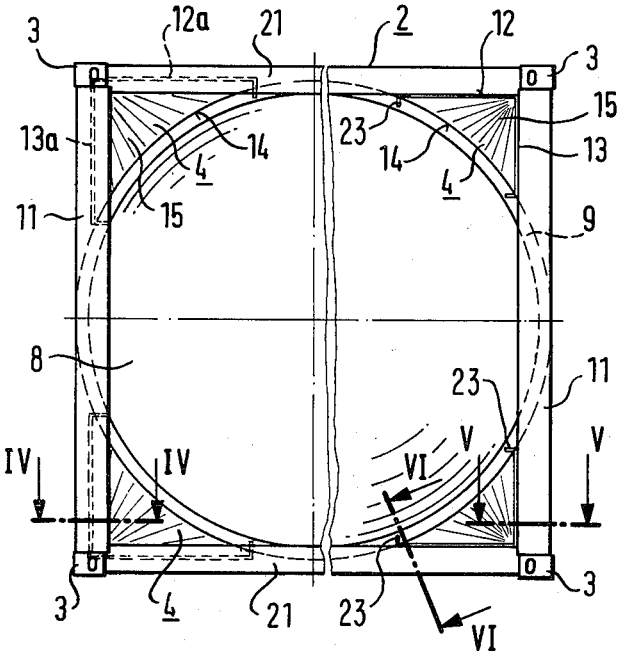
FIG. 3 is a front view of the freight container according to FIG. 1 with triangular regions of the saddle members extending parallel to the corner props of the transverse beams.

As may be seen from the end view of the freight container according to FIG. 3, the triangular surfaces may also extend parallel to the planes of the inner and outer flanks of the corner props and transverse beams of the end frames with which they are to be connected. Their outer edges 12*a* and 13*a* are also either butt welded to the corner props 11 and the transverse beams 21, or secured in an overlapping manner to the inner surfaces or outer surfaces of the corner props 11 and the transverse beams 21.

Figure 6:
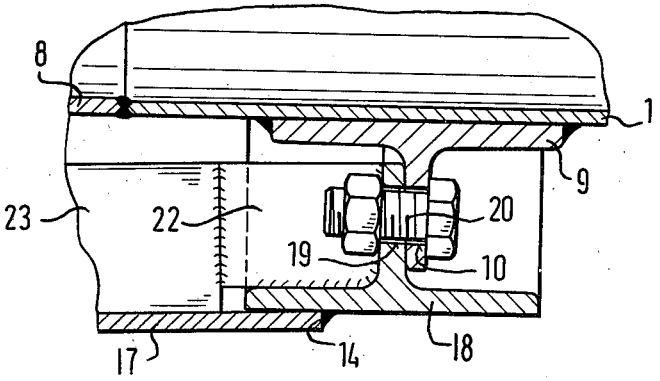

In accordance with FIG. 6, the circular closure edge 14 of the conical face 15 is connected to a flange ring 18. The latter has bolt holes 19 which match the bolt holes 10 in the flange ring 9 of the cylindrical vessel, and through which bolts 20 are inserted. During assembly, the flange ring 18 is initially tacked to the saddle member concerned only temporarily, and finally welded to the edge 14 only after the bolts 20 have again been released, so that the contractions which occur during welding are not transmitted to the vessel. Thereafter, the flanges 23 can also be connected to the flange rings 18 for the purpose of reinforcement via sheet metal closure pieces 22.

Figure 7:
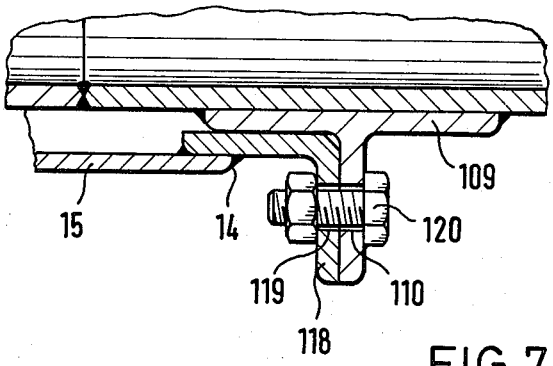
FIG. 7 is a section through a T-shaped securing ring with a bolted flange section of the saddle member.

In accordance with FIG. 7, the circular closure edge 14 of the conical surface 15 is connected to a saddle ring 118 in the form of an angle section. The latter has bolt holes 119, into which bolts 120 are inserted and which match the bolt holes 110 in the securing ring 109, which is in the form of a T-flange ring, of the cylindrical vessel. During assembly, the saddle ring 118 is preferably secured in the same manner as has already been described above in connection with the flange ring 18.

Figure 9:
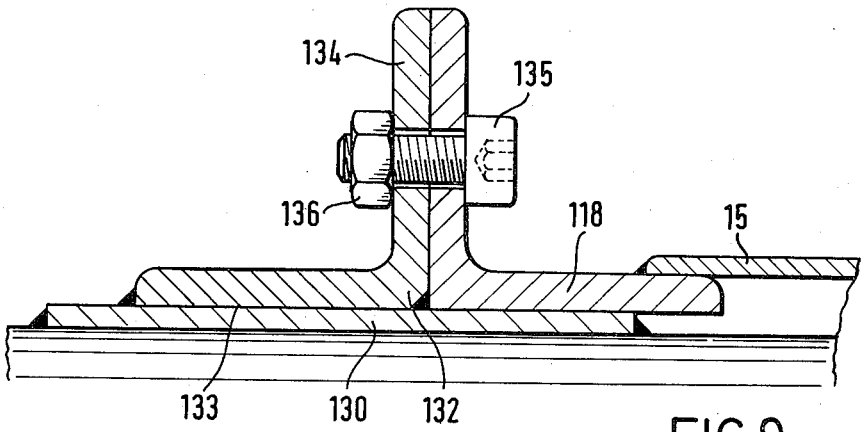
FIG. 9 is a section through a further embodiment of a securing ring having an angle section.
Figure 8:
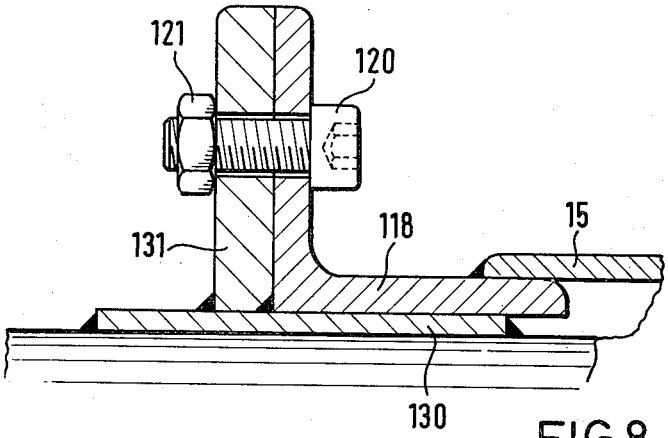
FIG. 8 is a further embodiment of the securing ring in section, with the use of a support ring having a flat iron ring welded thereto.

In order to improve the mounting of the saddle ring 118 on the vessel 1, a support ring 130 surrounding the shell of the vessel is welded on, in accordance with FIGS. 8 and 9. Owing to its own thickness, the ring 130 facilitates the pulling of the securing flange proper over the bulges of the welding seams between the floor and the shell of the vessel.

Since the further welded joints may be made on the support ring 130, the vessel is relieved of undesirable stresses due to welding during assembly. To this support ring 130 there is then, in accordance with FIG. 8, applied, initially loosely, a radially outwardly extending flange in the form of a flat iron ring 131. The saddle ring 118, which is also initially only pushed on to the support ring 130, is slid to the correct position, utilizing the clearance provided on the support ring 130, together with the flat iron ring 131, and firmly joined to the latter by means of bolts 120 and nuts 121. In this arrangement, the saddle members, formed from two external planar triangular faces 16 and a curved internal face, are welded along the outer edge 14 of the conical shell 15 to the saddle ring 118 which extends along the support ring 130.

Figure 10:
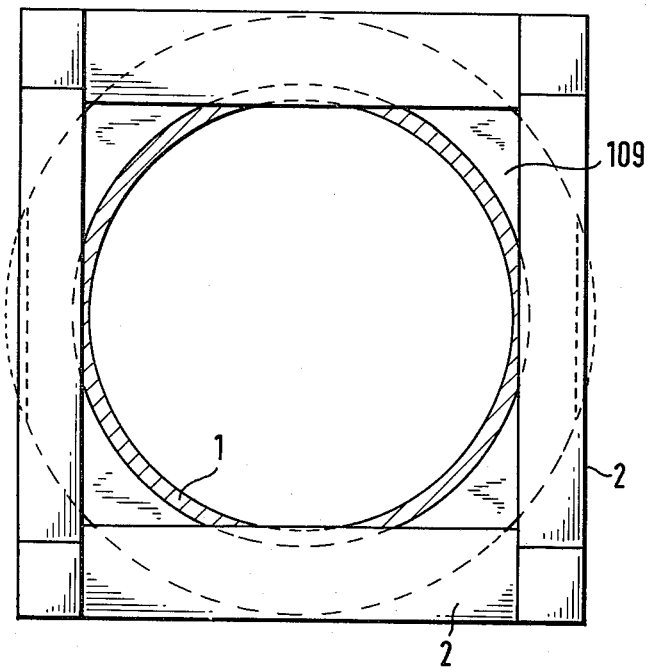
FIG. 10 is a cross-section through a securing ring surrounding the container and having vertically extending, lateral annular section.

As soon as the saddle ring 118, which is bolted to the flat iron ring 131, is in the correct position, the flat iron ring 131 together with the support ring 130 and the shell saddles are tacked to the end frame 2. For the purpose of completing all remaining assembly seams; the connecting bolts are released. Before finally again bolting up, corrosion protection is applied to the ring and flange surfaces which are later covered up. Thereafter, the radial flange and annular surface sections which protrude in the equatorial region of the vessel beyond permissible external dimensions, are severed by vertical secant cuts. See FIG. 10, in which the severed sections are shown dotted.

In FIG. 9, the flat iron ring 131 in accordance with FIG. 8 is replaced by an angle flange ring 132, whose cylindrical circular face 133 lies flat about the support ring 130, while its radial, outwardly extending flange 134 lies flat against the radially outwardly extending ring flange of the saddle ring 118.

The limb of the saddle ring 118, which lies against the support ring 130 protrudes, as required, towards the end frame of the vessel 1 beyond the end of the support ring 130 which is welded to the vessel shell, in order to provide better access and increased rigidity.

The bolted connected between the annular face 134 of the flange 132 and the annular face of the saddle ring 118 is produced by a combination of a unidirectional rotatable interiorly hexagonal bolt 135 and an exteriorly hexagonal nut 136, the exteriorly hexagonal nuts 136 being arrested on the angle flange 133 by virtue of their shape.

Figure 11:
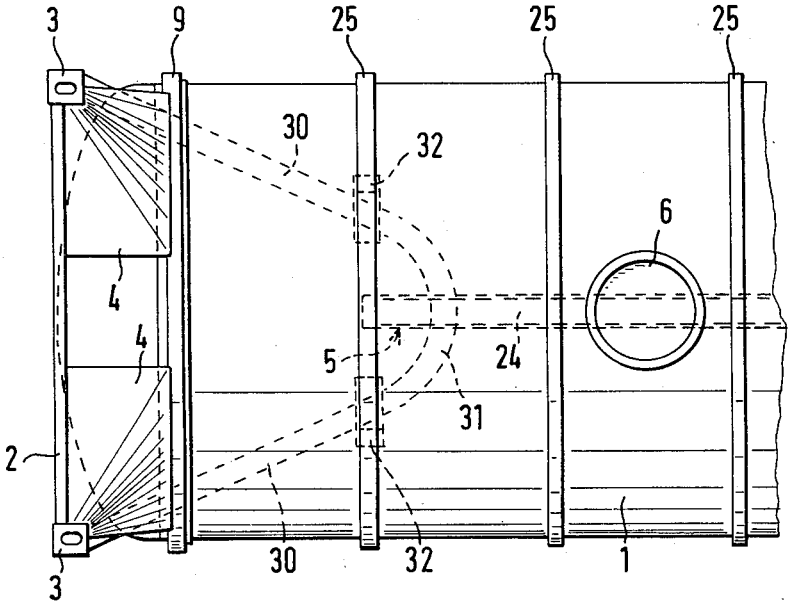
FIG. 11 is a plan of the freight container.

The two end frames are interconnected by a floor group 5. The latter consists, for example, in accordance with FIG. 11, of a longitudinal beam 24 and diagonal struts 26. In order to compensate for the uncontrolled contractions during welding of the liquid tank 1, with respect to the floor group, either the transition between the saddle members and the frame or the transition between the saddle members and the tank vessel have to be made longitudinally, displaceable until final assembly. As has already been mentioned, the displaceability is, in the embodiment described, achieved by overlapping of the conical faces 15 with the flanges 18. It is sufficient to provide such a sliding transition initially on one side of the freight container only. When all the bolts have been tightened up, the flanges 18 are finally joined to the conical faces 15 of the saddle members at one end of the vessel by means of conical seams 14. Instead of the bolted connection, it is, of course, possible to provide a welded joint, if the facility of dismantling at a later date is not required.

If the saddles are abuttingly joined to the flanges 18, the edges 12 and 13 of the triangular faces of the saddle members must intially lie against the corresponding frame portions, at one end of the vessel. This is achieved without difficulty in the embodiment in accordance with FIG. 5 and in an appropriate embodiment, in which triangular faces 16 lie against the corner supports 11 and the transverse beams 21 from the outside (FIG. 1, bottom). Only in the embodiment in accordance with FIG. 4, in which the edges of the triangular faces 16 are in abutting relationship to the corresponding frame portions, is it necessary to provide appropriate play on the flange ring for assembly purposes.

Figure 14:
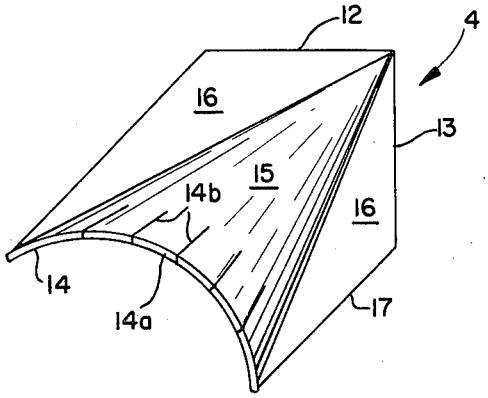
FIG. 14 is a perspective view of a saddle member in accordance with the present invention.

In order to take account of the deviation of the conical faces 15 from the longitudinal axis of the vessel for the purpose of joining them to the flange rings 18, it is advisable to bead or slit the conical edges as shown at 14*a*, 14*b*, respectively in FIG. 14. Slitting facilitates the process of deformation, which may be performed manually during assembly. It is, however, also sufficient to join the obliquely adjacent sheet metal saddle to the flange ring 18 by butt welding.

For the purposes of forming the floor group, the above-described diagonal struts may be welded to the longitudinal beam. In order to enable complete dismantling, it is, however, sensible to attach the diagonal struts also in a releasable manner, and thus also to make the frame of the container capable of being dismantled. For this purpose, in the embodiment in accordance with FIG. 13, the bolt connection 27 of the diagonal struts 26, which are joined together in a V-formation, may be secured at one end of the vessel by tension- and compression members 28 and 29 on the lower longitudinal beam 24 of the floor group. It is, however, also possible and advantageous to connect the diagonal strut arrangement directly to the saddle arrangement. For this purpose, the point of intersection between the reinforcing struts, which extend diagonally to the center of the vessel, and a reinforcing ring of the cylindrical tank vessel, must be disposed within the lower support zone described by the official standards (iso 1496/111). Two such proposals are shown in FIGS. 12 and 13.

Figure 12:
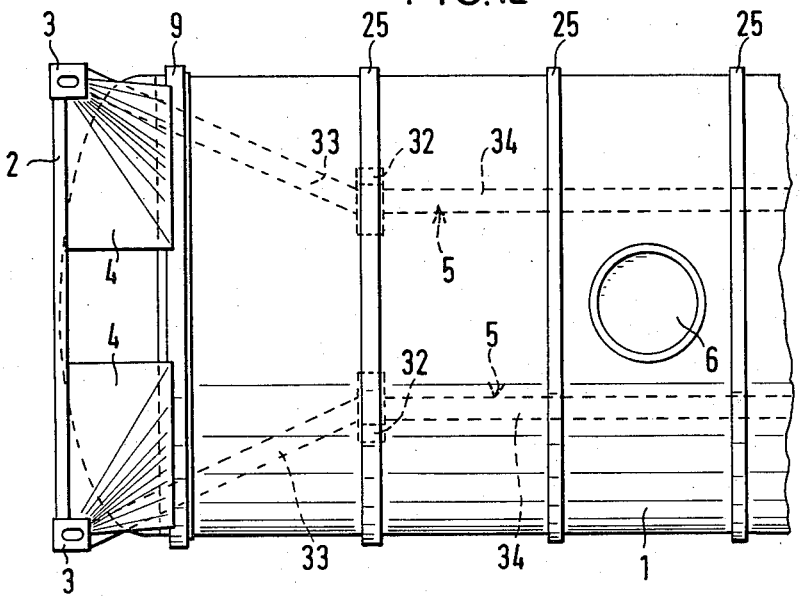
FIGS. 12 and 13 are representations of modified embodiments of the floor group.
Figure 13:
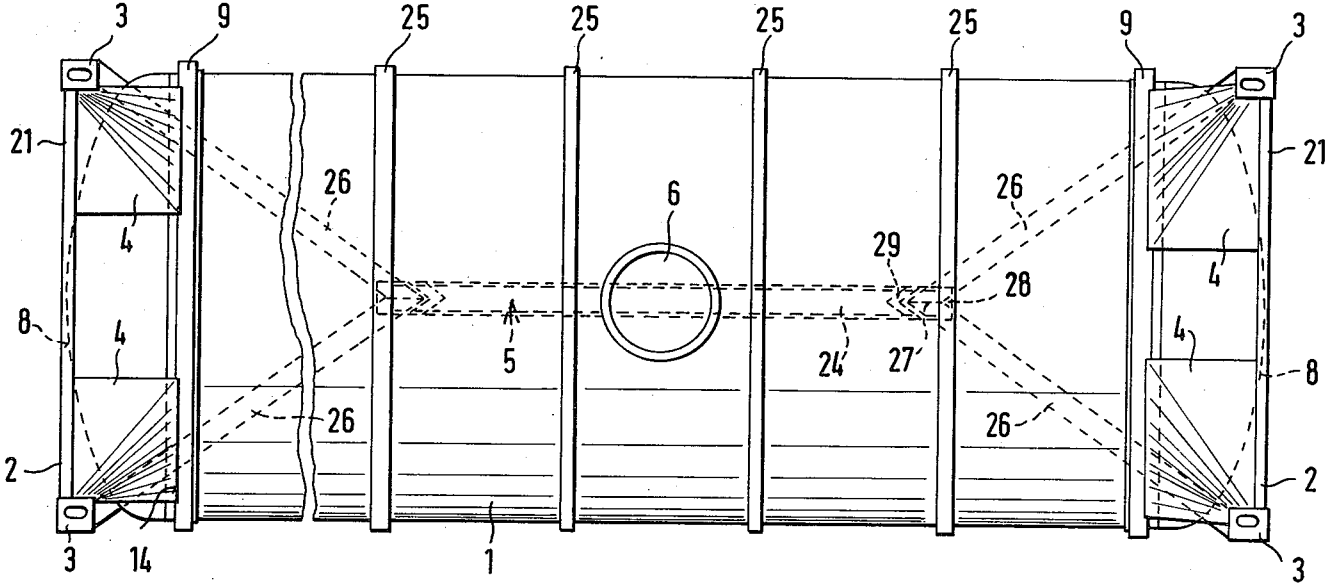

In accordance with FIG. 12, the diagonal struts 30 are bent in one piece at one end of the vessel. The stirrup-like central portion 31 is connected to the lower longitudinal beam 24 (preferably bolted). Moreover, the two struts 30 are bolted to a reinforcing ring 25 in the support zone of the vessel by means of suitable adapters 32.

In accordance with FIG. 12, two longitudinal beams 34 are provided on the underside of the vessel, instead of a central longitudinal beam 24. These longitudinal beams are connected by diagonal struts 33 to the end frames 2, so as to form the floor group. Here also the adaptors 32 serve for bolting the liquid vessel 1 to the floor group.

The saddle arrangement described is amenable to assembly and adjustment and has the advantage of almost ideally uniform transmission of all the forces which occur in use, to the tank circumference. This advantage is combined with the advantages of very convenient bolted assembly of the liquid vessel between the end frames. Moreover, the saddle members can at the same time be used for supporting service bridges or the like. Furthermore, the buckling strength of the sheet metal faces can be increased, especially in the planar region, by means of beads, reinforcing sections and the like in known manner, if required.

I claim:

1. A freight container for flowable substances comprising:

(a) a fully closed, substantially cylindrical vessel, said vessel having an outer wall that has metal rings extending circumferentially about said outer wall;

(b) two rectangular end frames including transverse members and vertical members interconnected by corner fittings for lifting and stacking said freight container; and (c) saddle members connected to said vessel on respective frame members comprising sheet sections in the form of an arched area and a planar triangular surface area adjacent each of opposite lateral edges of said arched area and the triangular surface areas being substantially perpendicular to each other, each of said saddle members being interposed between an associated corner of each end frame and said vessel, wherein each arched area is a conical surface having an apex located near said associated corner of each end frame and an arcuate base edge curved to conform with said wall of said vessel, concentrically adapted to said wall of said vessel and connected thereto, one of the triangular surface areas having an outer edge beginning near said apex of said conical surface, the length of said outer edge extending generally parallel along the length of a respective one of the transverse members of said rectangular end frames in close proximity thereto and the other of the triangular surface areas having an outer edge beginning near said apex of said conical surface, the length of the other outer edge extending generally parallel along the length of a respective one of the vertical members of the rectangular end frame, each of the outer edges being connected to its respective one of said members of the rectangular end frame.

2. A freight container according to claim 1, characterized in that said arcuate base edge of said conical surface of each saddle member is connected to one of said metal rings.

3. A freight container according to claim 2, characterized in that each of said metal rings is a T-profile ring member.

4. A freight container according to claim 2, characterized in that each of said metal rings overlies a support ring member, said support ring member extending along said wall of said vessel and being welded thereto.

5. A freight container according to claim 4, characterized in that each of said metal rings is formed by a flat iron ring welded perpendicularly to said support ring.

6. A freight container according to claim 4, characterized in that each of said metal rings is of an angle section having an outwardly extending flange member and a cylindrical part lying above said support ring member and being welded thereto.

7. A freight container according to claim 2, characterized in that the metal rings connected to the saddle member arcuate edges have a cylindrical part surrounding said vessel and a radial part extending outwardly therefrom, and being bolted to flange members attached to the conical surfaces of said saddle members.

8. A freight container according to claim 7, characterized in that each of said flange members is of an angle section, said angle section having a cylindrical part situated above said cylindrical part of the flange members, at an end facing one of said end frames of the container, being connected to said arcuate edge of said conical surface, and said angle section having a radially outwardly extending ring member part, said ring member part extending parallel to a radially outwardly extending part of said metal rings and being connected thereto.

9. A freight container according to claim 6 or 8, characterized in that said flange members of said angular sections are perpendicular to each other and are reinforced by gussets in regions of high concentrations of lines of forces.

10. A freight container according to claim 8, characterized in that the cylindrical part of said flange members extends beyond one of said support ring and cylindrical part parallel to said wall of said vessel in a direction toward an end frame of the container.

11. A freight container according to claim 8, characterized in that radially outwardly extending ring flange sections extending beyond the permissible width of the container are severed by a secantially guided vertical section.

12. A freight container according to claim 2, characterized in that at least one of said connections between said saddle members and said end frame, and said connections of saddle members with said ring member surrounding said vessel being on at least one vessel end carried out by lap welding.

13. A freight container according to claim 1, characterized in that the triangular surface areas extend parallel to a respective inner surface of said one of the adjacent members of said end frames to which they are connected.

14. A freight container according to claim 1, characterized in that the triangular surface areas have axially extending edges provided with flanges extending in approximately the longitudinal direction of said vessel.

15. A freight container according to claim 14, characterized in that each of the longitudinally extending flanges is connected at one end to one of the ring members via sheet metal closure pieces extending therebetween.

16. A freight container according to claim 1, characterized in that the outer edge of each of said triangular surface areas extends beyond said adjacent members of said end frames.

17. A freight container according to claim 1, characterized in that the axially outer edges of the triangular surface areas are butt-welded to the adjacent members of said end frames associated therewith.

18. A freight container according to claim 1, characterized in that said arcuate edge of said conical surface being connected to a flange member, said flange member being bolted to a respective one of said metal rings.

19. A freight container according to claim 18, characterized in that said flange members are connected to said arcuate edges of said conical surfaces by lap welds.

20. A freight container according to claim 1, characterized in that said arcuate edges of said conical surfaces are at least partly beaded.

21. A freight container according to claim 1, characterized in that said end frames are mutually connected to a floor group having at least one beam extending longitudinally of the vessel and props extending obliquely from said beam to lower corner fittings of said frames, said props being connected to said longitudinal beam by bolts.

22. A freight container according to claim 21, characterized in that each of said props is formed of a part bent in the shape of a stirrup.

23. A freight container according to claim 1, wherein one of said saddle members is disposed between said vessel and each of eight corner areas defined by said two rectangular frames.

24. A freight container according to claim 1, wherein said arcuate base edge extends continuously along said wall of said vessel.

25. A freight container according to claim 1, wherein said arcuate base edge is provided with slits.

26. A freight container according to claim 1, wherein each of the triangular surface areas has a free edge extending longitudinally between said arcuate base edge and the respective one of the frame members to which it is connected.

* * * * *